United States Patent [19]

Morris

[11] 4,452,193

[45] Jun. 5, 1984

[54] ENGINE WITH BELT MEANS CONNECTING A FLYWHEEL PULLEY A GOVERNOR DRIVE PULLEY, AND A COOLING LIQUID PUMP DRIVE PULLEY

[75] Inventor: Richard L. Morris, Galesburg, Ill.

[73] Assignee: Outboard Marine Corporation, Waukegan, Ill.

[21] Appl. No.: 359,757

[22] Filed: Mar. 19, 1982

[51] Int. Cl.[3] ..... F02B 67/06

[52] U.S. Cl. ..... 123/195 R; 123/195 A; 123/70 R

[58] Field of Search ..... 123/195 A, 195 R, 195 H, 123/376; 474/70 R

[56] References Cited

U.S. PATENT DOCUMENTS

| | | | |
|---|---|---|---|
| 2,643,510 | 6/1953 | Kiekhaefer | 123/195 R |
| 2,725,866 | 12/1955 | Scheiterlein | 123/195 A |
| 2,844,133 | 7/1958 | Thompson | 123/52 MV |
| 2,969,781 | 1/1961 | Kolbe | 123/195 R |
| 3,092,084 | 6/1963 | Thorner | 123/376 |
| 3,418,993 | 12/1968 | Scheiterlein et al. | 123/195 R |
| 4,125,036 | 11/1978 | Nakamura et al. | 123/195 A |
| 4,180,024 | 12/1979 | Hernandez | 123/195 A |

*Primary Examiner*—Craig R. Feinberg
*Assistant Examiner*—David A. Okonsky
*Attorney, Agent, or Firm*—Michael, Best & Friedrich

[57] ABSTRACT

Disclosed is an internal combustion engine including a flywheel pulley connected to a crankshaft, a governor drive pulley, and a cooling liquid pump drive pulley with belt means driveably connecting the flywheel pulley, the governor drive pulley and the pump drive pulley.

In one embodiment of this invention, the belt means is a belt and the flywheel pulley, the governor drive pulley, the pump drive pulley, an idler pulley and the flywheel pulley are driveably connected in series. The engine includes a cooling liquid system, a fan connected to the cooling liquid pump and a radiator adjacent the fan. The engine is a two-stroke engine and the engine crankshaft is in a vertical position. The flywheel is rotatable about a first axis and the governor drive pulley and the idler pulley are coaxial about a second axis at a right angle to the first axis, and the cooling liquid pump is rotatable abut an axis extending perpendicular to the first and second axes.

9 Claims, 3 Drawing Figures

ENGINE WITH BELT MEANS CONNECTING A FLYWHEEL PULLEY A GOVERNOR DRIVE PULLEY, AND A COOLING LIQUID PUMP DRIVE PULLEY

BACKGROUND OF THE INVENTION

This invention relates to engines having belt means driveably connecting a flywheel pulley, a governor drive pulley, and a cooling liquid pump drive pulley.

SUMMARY OF THE INVENTION

This invention provides an internal combustion engine including a flywheel pulley connected to a crankshaft, a governor drive pulley, and a cooling liquid pump drive pulley with belt means driveably connecting the flywheel pulley, the governor drive pulley and the pump drive pulley. In one embodiment of this invention, an idler pulley is also driveably connected by a belt means to the flywheel pulley, the governor drive pulley and the pump drive pulley.

In another embodiment of this invention, the belt means is a belt and the flywheel pulley, the governor drive pulley, the pump drive pulley, the idler pulley and flywheel pulley are driveably connected in series. The engine includes a cooling liquid system, a fan connected to the cooling liquid pump and a radiator adjacent the fan. The engine is a two-stroke engine and the engine crankshaft is in a vertical position. The flywheel is rotatable about a first axis and the governor drive pulley and the idler pulley are coaxial about a second axis at a right angle to the first axis, and the cooling liquid pump is rotatable about an axis extending perpendicular to the first and second axes.

One of the principle features of this invention is the provision of a speed governed internal combustion engine suitable for use in original equipment manufacturing applications. Other features and advantages of embodiments of the invention will become apparent upon reviewing the following drawings, the detailed description and the appended claims.

Figure 3:
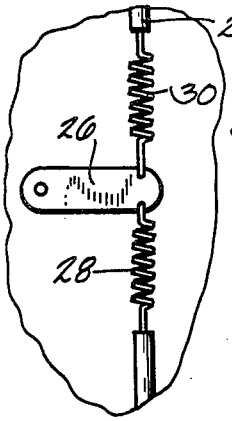
FIG. 3 is an enlarged view of a carburetor throttle, throttle spring and governor output tension spring as incorporated in the engine shown in FIGS. 1 and 2.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Figure 1:
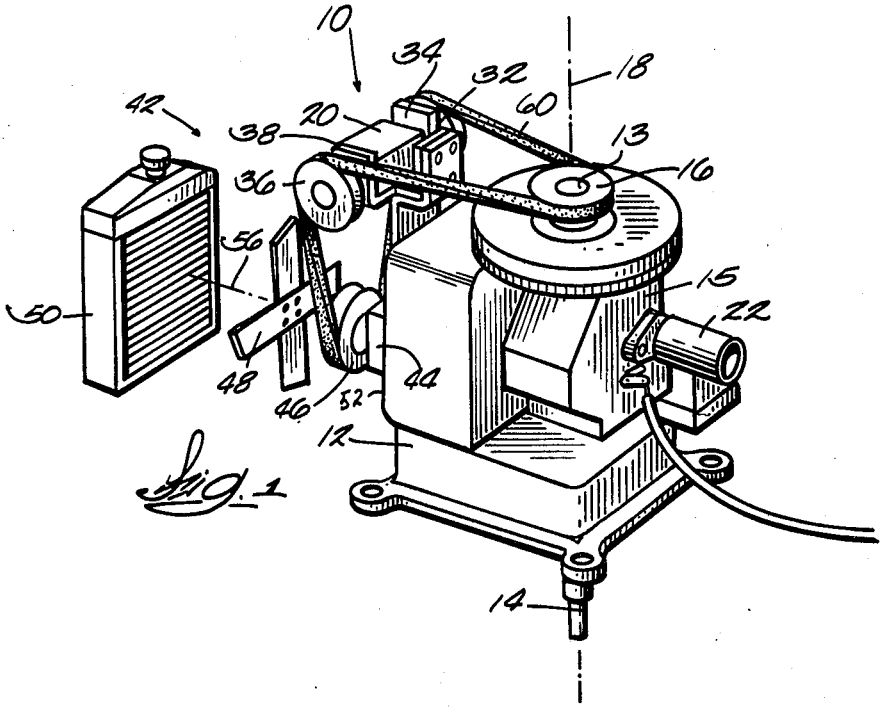
FIG. 1 is a perspective view of one embodiment of this invention wherein a flywheel pulley, a governor drive pulley, a pump drive pulley, an idler pulley and the flywheel pulley are connected in series.

Depicted in FIG. 1 is a two-stroke engine 10 mounted on a base 12 with its crankshaft 14 assuming a vertical orientation. Mounted on one end 13 of the crankshaft 14 extending out from an engine block 15 is a flywheel pulley 16 rotatable about an axis 18 defined by the crankshaft 14.

Figure 2:
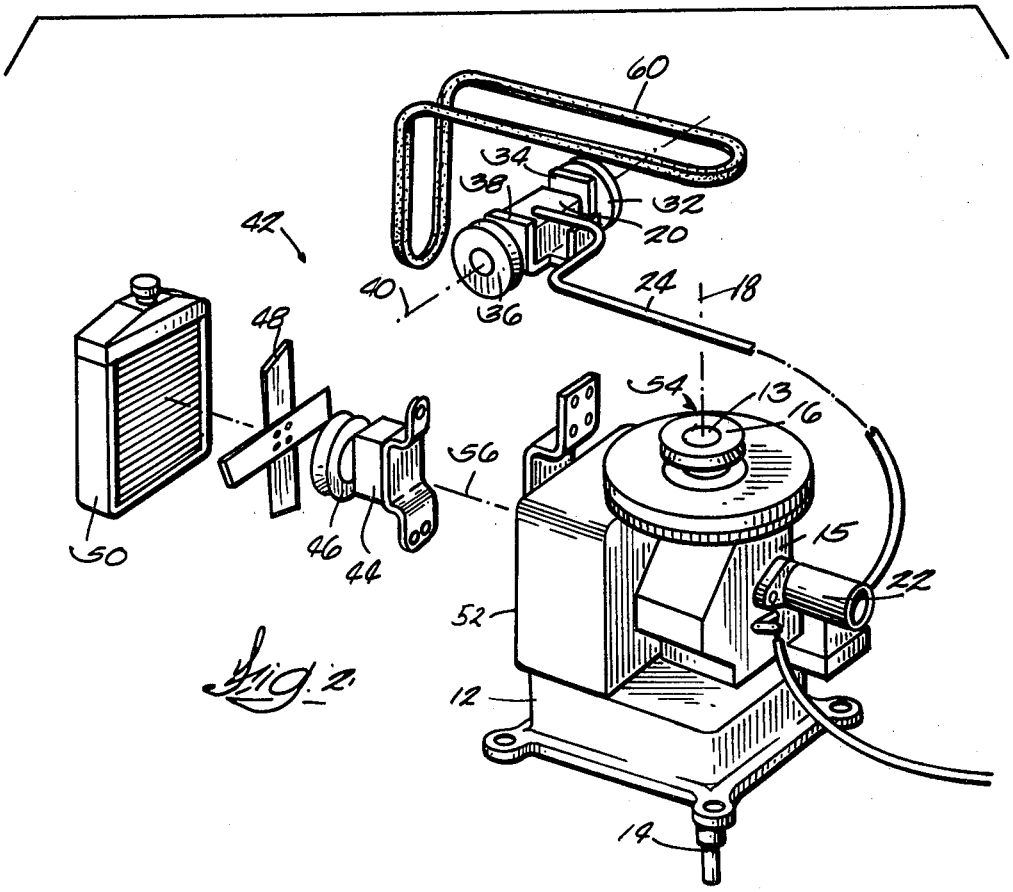
FIG. 2 is a perspective view of the engine and components shown in FIG. 1 in a dissassembled, exploded relationship.

A governor assembly 20 is mounted on the engine block 15. The governor 20 is of a conventional design, and controls a carburetor 22 on the engine 10 through a throttle cable 24, as illustrated in FIG. 2. The carburetor includes a throttle 26 which is controlled by an operator changing the tension of the throttle spring 28, which affects the balance of the governor output tension spring 30, as shown in FIG. 3. As the engine crankshaft's rpm increases, the governor 20 causes the cable 24 to compress the governor output tension spring 30, thereby moving the throttle 26 and reducing the speed of the engine 10. A throttle spring 28 attached to an operator control (not shown), however, tends to counteract the operation of the governor 20 by pushing the throttle 26 in a direction opposite the tension spring 30. The relative influences of the operator and the governor are controlled by the design of springs 28 and 30.

The governor 20 has a governor drive pulley 32 on one side 34 of the governor assembly 20, and an idler pulley 36 on the other side 38 of the governor assembly 20. The governor drive pulley 32 and idler pulley 36 are coaxial about a second axis 40 which is at a right angle to the axis 18 formed by the crankshaft 14.

The engine 10 includes a cooling system 42, only part of which is shown in FIGS. 1 and 2. The cooling system 42 utilizes a cooling liquid pump 44 for circulating cooling liquid through the engine block 15. The cooling liquid pump 44 is driven by a cooling liquid pump drive pulley 46. Attached to the cooling liquid pump drive pulley 46 is a fan 48 for forcing air through a radiator 50 adjacent the fan 48. The engine cooling liquid system 42, including the cooling liquid pump 44, pump drive pulley 46, radiator 50 and fan 48 are all of a conventional design. The cooling liquid pump 44, fan 48 and radiator 50 are on a side 52 of the engine block 15, adjacent a side 54 of the engine block 15 which has the flywheel pulley 16. The cooling liquid pump drive pulley 46 is rotatable about an axis 56 which extends perpendicularly to the crankshaft axis 18 and the axis 40 of the governor drive pulley 32 and idler pulley 36.

A belt means or belt 60 is provided for driveably connecting the flywheel pulley 16, the governor drive pulley 32, the cooling liquid pump drive pulley 46, the idler pulley 36 and the flywheel pulley 16 in series.

More particularly, the belt 60 is continuous and extends from the flywheel pulley 16 to the governor drive pulley 32, and then around the governor drive pulley 32 to the cooling liquid pump drive pulley 46. The belt 60 then extends around the pump drive pulley 46 to the idler pulley 36, and then around the idler pulley 36 back to the flywheel pulley 16.

Various of the features of the invention are set forth in the following claims.

I claim:

1. An internal combustion engine including opposed first and second sides and a third side adjacent said first and second sides, carburetion means for determining a speed of said engine and on said first side, a crankshaft having an axis normal to the third side, a flywheel pulley on said third side and connected to said crankshaft, a cooling liquid pump drive pulley on said second side, governor means operably connected to said carburetor means for governing the speed of said engine, said governor means including a governor drive pulley located between said flywheel pulley and said cooling liquid pump drive pulley, and belt means driveably connecting said flywheel pulley, said governor drive pulley, and said pump drive pulley.

2. An internal combustion engine including opposed first and second sides and a third side adjacent said first and second sides, carburetion means for determining a speed of said engine and on said first side, a crankshaft having an axis normal to the third side, a flywheel pulley on said third side and connected to said crankshaft, a cooling liquid pump drive pulley on said second side, governor means operably connected to said carburetion means for governing the speed of said engine, said governor means including a governor drive pulley located between said flywheel pulley and said cooling liquid pump drive pulley, an idler pulley rotatable about the axis of rotation of said governor drive pulley, and belt means driveably connecting said flywheel pulley, said governor drive pulley, said pump drive pulley and said idler pulley.

3. An internal combustion engine including opposed first and second sides and a third side adjacent said first and second sides, carburetion means for determining a speed of said engine and on said first side, a crankshaft having an axis normal to the third side, a flywheel pulley on said third side and connected to said crankshaft, a cooling liquid pump drive pulley on said second side, governor means operably connected to said carburetor means for governing the speed of said engine, said governor means including a governor drive pulley located between said flywheel pulley and said cooling liquid pump drive pulley, an idler pulley rotatable about the axis of rotation of said governor drive pulley. and belt means driveably connecting in series said flywheel pulley, said governor drive pulley, said pump drive pulley, said idler pulley, and said flywheel pulley.

4. An engine according to any of claims 2 or 3 wherein said flywheel pulley is rotatable about a first axis, wherein said governor drive pulley and said idler pulley are coaxial about a second axis at a right angle to said first axis and said cooling liquid pump drive pulley is rotatable about a third axis extending perpendicular to said first and said second axes.

5. An engine according to any of claims 1, 2 or 3 wherein the belt means comprises a continuous belt.

6. An engine according to any of claims 1, 2 or 3 wherein the engine is a two-stroke engine.

7. An engine according to any of claims 1, 2 or 3 wherein the engine crankshaft is in a vertical position.

8. An engine according to claim 7 and further including a fan connected to said cooling liquid pump drive pulley.

9. An engine according to claim 8 and further including a liquid cooling system comprising a radiator adjacent said fan.

* * * * *